US006318009B1

(12) United States Patent
De Maneville et al.

(10) Patent No.: US 6,318,009 B1
(45) Date of Patent: Nov. 20, 2001

(54) STEAM IRON WITH WATER VALVE

(75) Inventors: Guy De Maneville, Douvres la Delivrande; Jacky Fourny, Berus, both of (FR)

(73) Assignee: Moulinex S.A., Cormelles-le-Royal (FR)

( * ) Notice: Subject to any disclaimer, the term of this patent is extended or adjusted under 35 U.S.C. 154(b) by 0 days.

(21) Appl. No.: 09/647,165

(22) PCT Filed: Mar. 23, 1999

(86) PCT No.: PCT/FR99/00672

§ 371 Date: Sep. 27, 2000

§ 102(e) Date: Sep. 27, 2000

(87) PCT Pub. No.: WO99/50496

PCT Pub. Date: Oct. 7, 1999

(30) Foreign Application Priority Data

Mar. 27, 1998 (FR) ..... 98 03849

(51) Int. Cl.[7] ..... D06F 75/18
(52) U.S. Cl. ..... 38/77.8
(58) Field of Search ..... 38/77.8, 77.1, 38/77.5

(56) References Cited

U.S. PATENT DOCUMENTS 3,468,043 * 9/1969 Turner ..... 38/77.1
3,889,406 * 6/1975 Chivers et al. ..... 38/77.83
4,669,207 * 6/1987 Hennuy et al. ..... 38/77.8
5,531,037 * 7/1996 Pons et al. ..... 38/77.8
5,630,287 4/1997 Shimosaka et al. .

FOREIGN PATENT DOCUMENTS 0 184 496 6/1986 (EP) .
0 831 164 4/1998 (EP) .
2217351 * 10/1989 (GB) ..... 38/77.1

* cited by examiner

*Primary Examiner*—Ismael Izaguirre
(74) *Attorney, Agent, or Firm*—Young & Thompson

(57) ABSTRACT

Steam iron comprising a water reservoir (17) communicating with a vaporization chamber (12) through an outlet (23) having a vertical communication passage (25), and a device (35) for adjusting the water admission flow rate into the vaporization chamber comprising a vertical throttle (39) whose lower end (44) has a bulge (46) and whose upper end (41) is secured to a manual control button (43). The bulge (46) of the throttle (39) is mounted gripped in the passage (25) of the outlet (23) and pointwise bridges a vertical groove (52) which is provided over a portion of the height of the passage (25) and which thus delimits with the bulge (46) of the throttle (39) a cross-section for passage of the water when the throttle (39) is in its steaming position.

11 Claims, 5 Drawing Sheets

STEAM IRON WITH WATER VALVE

FIELD OF THE INVENTION

The present invention relates to steam irons which comprise a water reservior communicating with a vaporization chamber via an outlet having a vertical communication passageway, and a device for adjusting the water admission rate into the steam chamber comprising a vertical throttle whose lower end has a bulge and whose upper end is secured to a manual control button, said throttle being movable with an axial translatory movement within the passage of the outlet, under the action of the manual control button, between a so-called dry position in which the throttle completely closes the passage, and at least one so-called steaming position in which water can pass through the passage.

BACKGROUND OF THE INVENTION

In known steam irons of this type, the throttle is of generally cylindrical shape and is mounted gripped and passing through the passage of the outlet and its bulge opens permanently into the steam chamber; the throttle comprises a longitudinal groove over a portion of its length and is movable axially to occupy either the dry position in which the two ends of the groove are located on the same side of the passage, thereby preventing any passage of water, or its steaming position in which the two ends of the groove are located on opposite sides of the passage, thereby permitting the passage of the water into the steam chamber via the groove in the throttle. However, because the throttle is in surface contact over all the height of the passage of the outlet, each manipulation of the throttle by the user creates high stress in the outlet which operates at a relatively high temperature. Because of this stress to which the outlet is subjected, the pressure drops about the throttle are relatively high, such that when the throttle is in its steaming position, also called the steam position, the flow rate of water passing continuously into the vaporization chamber is particularly irregular, and this the more so as the level of water in the reservoir falls in the course of ironing; the continuous flow rate of steam which results is thus itself very irregular, thereby decreasing the quality of the pressing.

OBJECT OF THE INVENTION

The invention has particularly for its object to overcome these drawbacks and to provide a steam iron having a device for regulating the flow rate of water, of the type described above, which will be simple, less costly, reliable and particularly efficacious to ensure, in the steaming position, a great regularity of the continuous water flow rate no matter what the level of water in the reservoir.

SUMMARY OF THE INVENTION

According to the invention, the bulge of the throttle is mounted gripped in the passage of the outlet and pointwise bridges a vertical groove which is provided over a portion of the height of the passage and which thus defines with the bulge of the throttle a section of water passage when the throttle is in its steaming position.

Thus, in the steaming position, the bulge of the throttle defines with the vertical groove of the outlet a cross-section for passage of water which is thereafter only at one point, thereby permitting obtaining a very regular flow of water not only when the level of water in the reservoir is at a maximum, but also when it is very low, which thus leads to a steam flow rate which itself is very regular, and hence a high quality of pressing.

According to one preferred embodiment, the passage of the outlet comprises a lower portion which is closed by the bulge of the throttle when this latter is in its dry position, whilst the vertical groove extends above the lower portion of the passage and has a cross-section which varies continuously increasing toward the upper edge of the passage, the throttle thus passing from its dry position to its steaming position with an axial translatory movement that is upwardly directed.

In this embodiment, according to another characteristic of the invention, in the passage of the outlet is provided at least one vertical slot extending over a height from the upper end of the groove and the upper edge of the passage, such that the throttle, by axial upward movement along a predetermined path, comes to occupy a so-called self-cleaning position in which the bulge of the throttle uncovers the slot by being partially in bearing relation against the internal surface of the vertical wall of the passage so as to form a passage permitting abundant flow of water.

Thus, thanks to a simple axial movement of the throttle, the user has a disposition in an easy manner, various positions of adjustment such as the dry position, the steaming position with variable flow rate and the self-cleaning position.

BRIEF DESCRIPTION OF THE DRAWING

The characteristics and advantages of the invention will be further apparent from the description which follows, by way of non-limiting example, with reference to the accompanying drawings, in which.

DETAILED DESCRIPTION OF THE INVENTION

Figure 1:
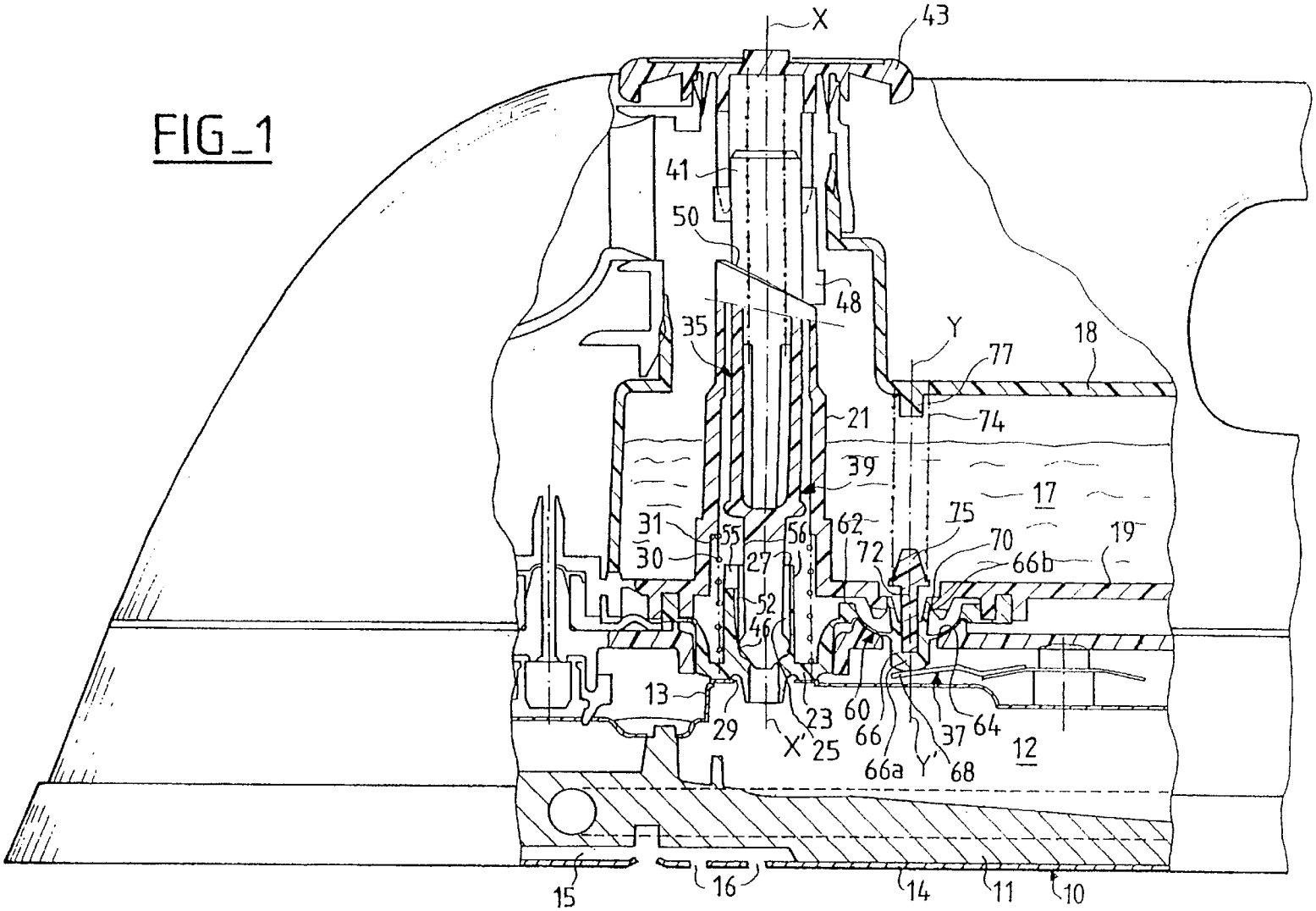
FIG. 1 is a schematic view in partial cross-section with parts broken away, of a steam iron provided with a device for adjustment of the water flow rate according to the invention, in the dry position (no steam)

The steam iron shown in FIGS. 1 and 3 to 5 comprises a sole plate 10 comprising a heating base 11 in which is provided a vaporization chamber 12 closed by a cover 13, and a thin pressing plate 14 which is secured to the lower surface of the heating base 11 by any suitable securement means and whose external surface forms a pressing surface; the vaporization chamber 12 communicates, via channels 15 for the distribution of steam recessed into the lower surface of the base 11, with outlet holes for steam 16 pierced through the plate 14.

Above the vaporization chamber 12 is disposed a water reservoir 17 having an upper horizontal wall 18 and a bottom horizontal wall 19 from which extends a vertical chimney 21, for example of cylindrical shape. The reservoir 17 communicates with the vaporization chamber 12 through an outlet 23 made of a flexible plastic material, such as an elastomer of the silicone type, and pierced by a vertical passage 25, for example of cylindrical shape, which is coaxial with the chimney 21 of the reservoir 17, whose upper edge 27 is located in the lower outlet of the chimney 21, and which opens into the vaporization chamber 12 through an opening 29 provided in the cover 13. The outlet 23 is maintained in sealed bearing relationship against the cover 13, about the opening 29 of the latter, by means of a spiral compression spring 30 interposed coaxially about the passage 25 between the joint 23 and an annular shoulder 31 formed on the internal wall of the chimney 21 of the reservoir 17.

The iron of FIGS. 1 and 3 to 5, also comprises a device 35 for adjusting the water admission flow rate into the steam chamber, as well as a non-drip device 37 associated with the reservoir 17 and arranged laterally of the chimney 21 of the reservoir 17, for example in line with this chimney, as shown in FIGS. 1 and 3 to 5.

Figure 2:
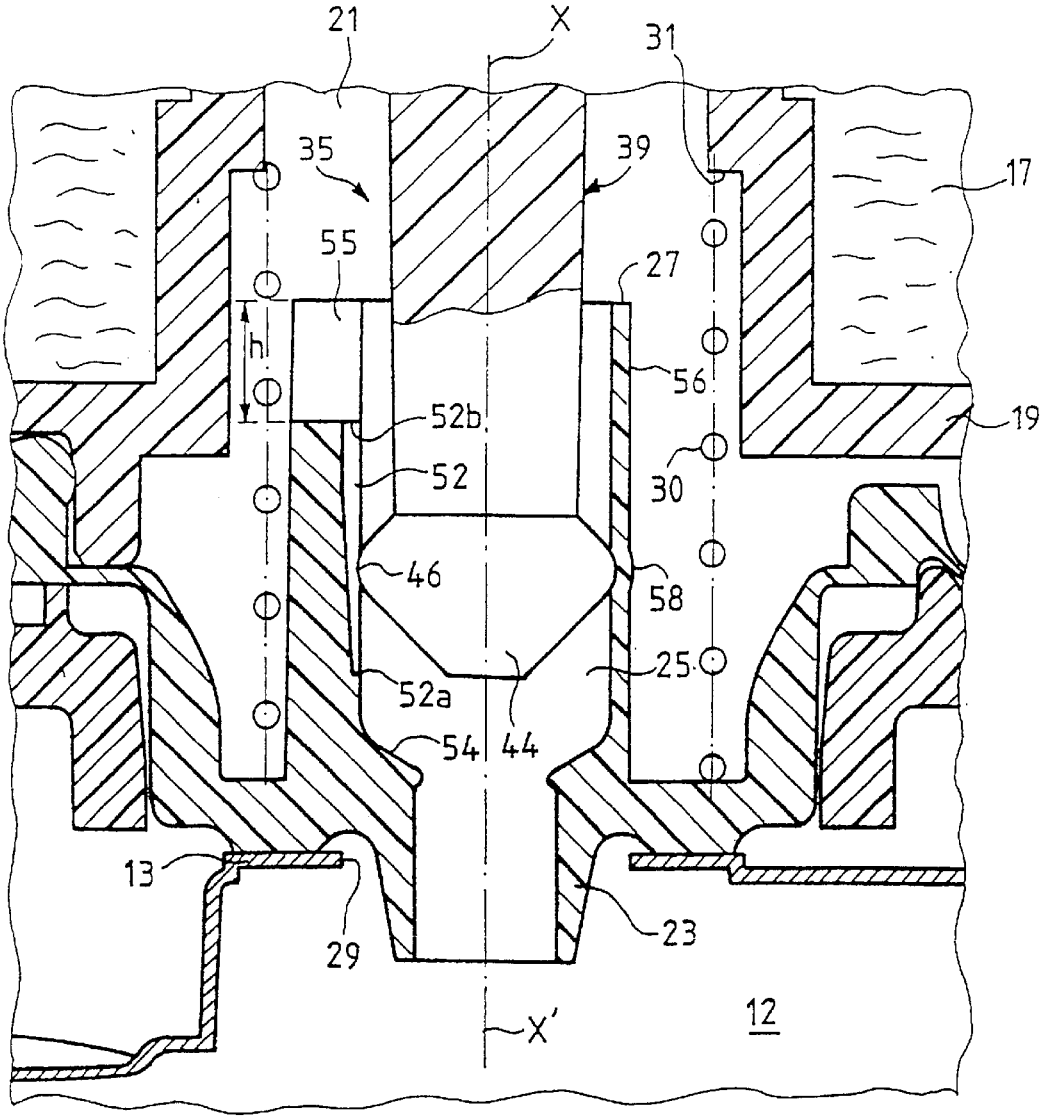
FIG. 2 is a partial cross-sectional view, on an enlarged scale, of a portion of the device for adjusting the flow rate of water, of FIG. 1, the latter occupying a steaming position with a predetermined flow rate.

The device 35 for adjusting the water flow rate comprises a vertical cylindrical throttle 39, with an axis XX', mounted coaxially within the chimney 21 of the reservoir 17, whose upper end 41 is secured to a manual control button 43, of the rotatable type in this embodiment, disposed projecting in the upper region of the iron, and whose lower end 44 is shaped as an ogive, better seen in FIG. 2, having an annular bulge or swelling 46.

Preferably, the chimney 21 of the reservoir 17 rises to a height above the maximum water level of the reservoir, thereby permitting omitting any sealing joint between the chimney and the throttle that passes through it.

The throttle 39 is movable axially within the passage 25 of the outlet 23, under the action of the rotatable button 43, and being subject, in this example, to means permitting imposing on it a helicoidal movement resulting from a movement of rotation accompanied by a movement of axial translation. In the embodiment shown in FIGS. 1 and 3 to 5, these means to impart to the throttle 39 a helicoidal movement comprise a wing forming a cam 48 which extends radially of the throttle 39, at the upper end 41 of this latter, and which is adapted to move by rotation of the button 43 along a ramp 50 provided on the upper edge of the chimney 21 of the reservoir 17.

Under the action of the rotatable button 43, the throttle 39 with helicoidal movement is adapted to occupy either a so-called dry position (without steam) in which it completely closes the passage 25 of the outlet 23, or at least one so-called steaming position, also called a steam position, in which the water can pass through the passage 25 and be injected into the vaporization chamber 12 with a predetermined flow rate.

It should be noted that in the case of a manual control button 43 of the pushbutton type, the means permitting impressing on the throttle 39 a helicoidal movement are constituted by means suitable for transforming linear movement into helicoidal movement.

According to the invention, as is clearly seen in FIG. 2, the annular bulge 46 of the throttle 39 is mounted gripped in the passage 25 of the outlet 23 and can bridge at a particular point a vertical groove 52 which is provided over a portion of the height of the passage 25 and which thus delimits with the bulge 46 or throttle 39 a cross-section for passage of water when the throttle 39 is in its steaming position.

Figure 3:
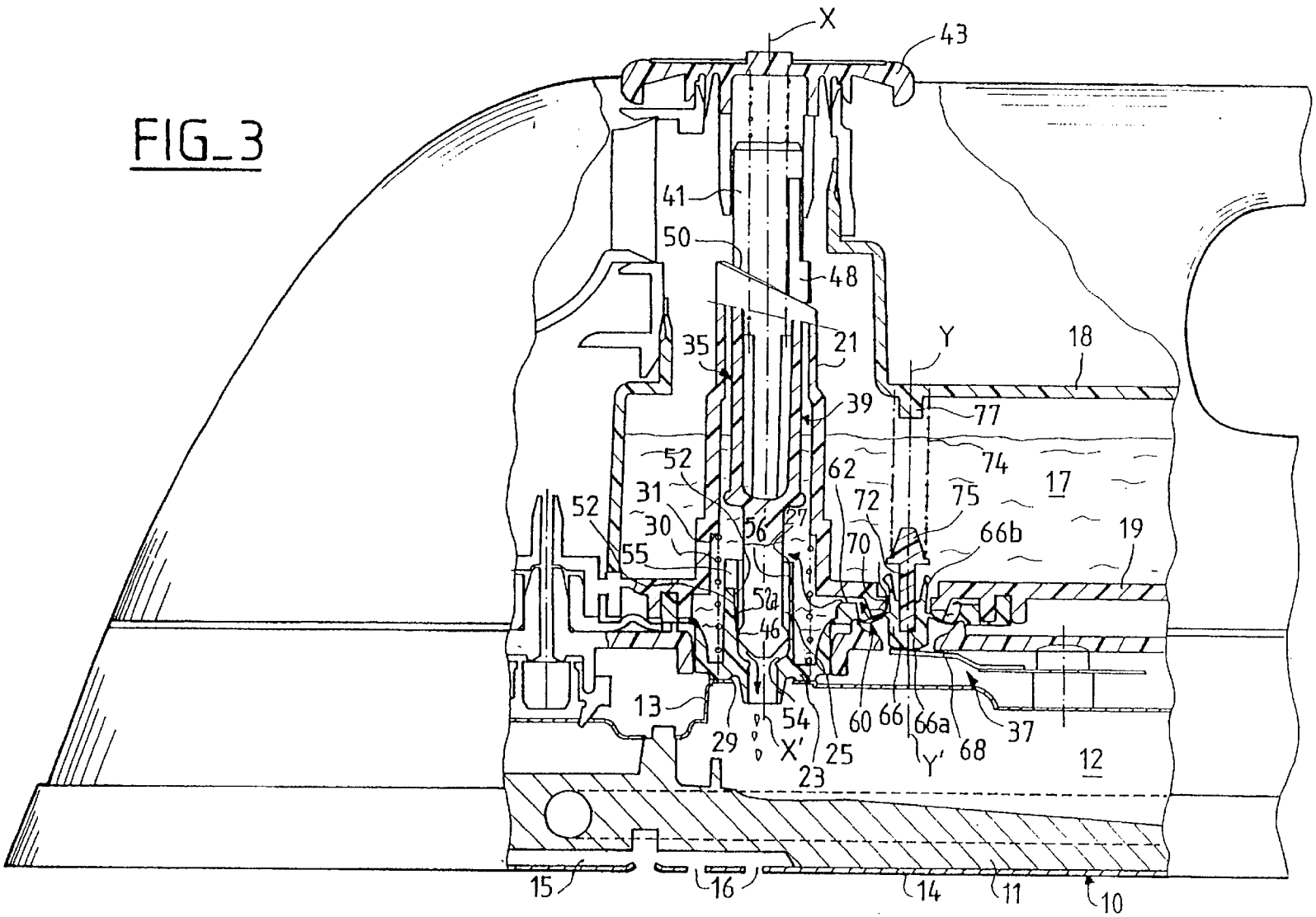
FIGS. 3 to 5 are views similar to FIG. 1 and showing respectively the adjustment device for the flow rate of water in the steaming position at minimum flow rate (FIG. 3), in a steaming position at maximum flow rate (FIG. 4) and in a self-cleaning position (FIG. 5).

In a preferred embodiment, the passage 25 of the outlet 23 comprises, substantially in its lower position, an annular narrowed region 54, better seen in FIG. 2, which forms a seat receiving the annular bulge 46 of the throttle 39 when the latter occupies its dry position (see FIG. 1), thereby closing the passage 25, and as a result preventing the injection of water. In this example, as is seen clearly in FIG. 2, the vertical groove 52 extends above this narrowed portion 54 of the passage and has a cross-section varying continuously increasing toward the upper edge 27 of the passage 25, thereby permitting the throttle 39 to occupy a steaming position with a continuously variable flow rate of water, hence a variable steam flow rate, for example of the order of 5 to 40 g/min. In FIG. 3, there is shown the throttle 39 in the steaming position with minimum flow rate in which its annular bulge 46 bridges at one point the lower end 52*a* of the groove 52, permitting a dropwise flow of water into the vaporization chamber 12, whilst in FIG. 4, the throttle 39 occupies its maximum steam flow rate position in which its annular bulge 46 bridges a point on the upper end 52*b* of the groove 52, permitting in this case a rapid flow of water into the vaporization chamber 12.

Thanks to the pointwise bridging of the groove 52 by the annular bulge 46 of the throttle 39 in the steaming position (FIGS. 3 and 4), the flow of water into the vaporization chamber 12 via the selected cross-section of the groove 52 will be very regular, and this no matter what the level of water in the reservoir 17.

Figure 5:
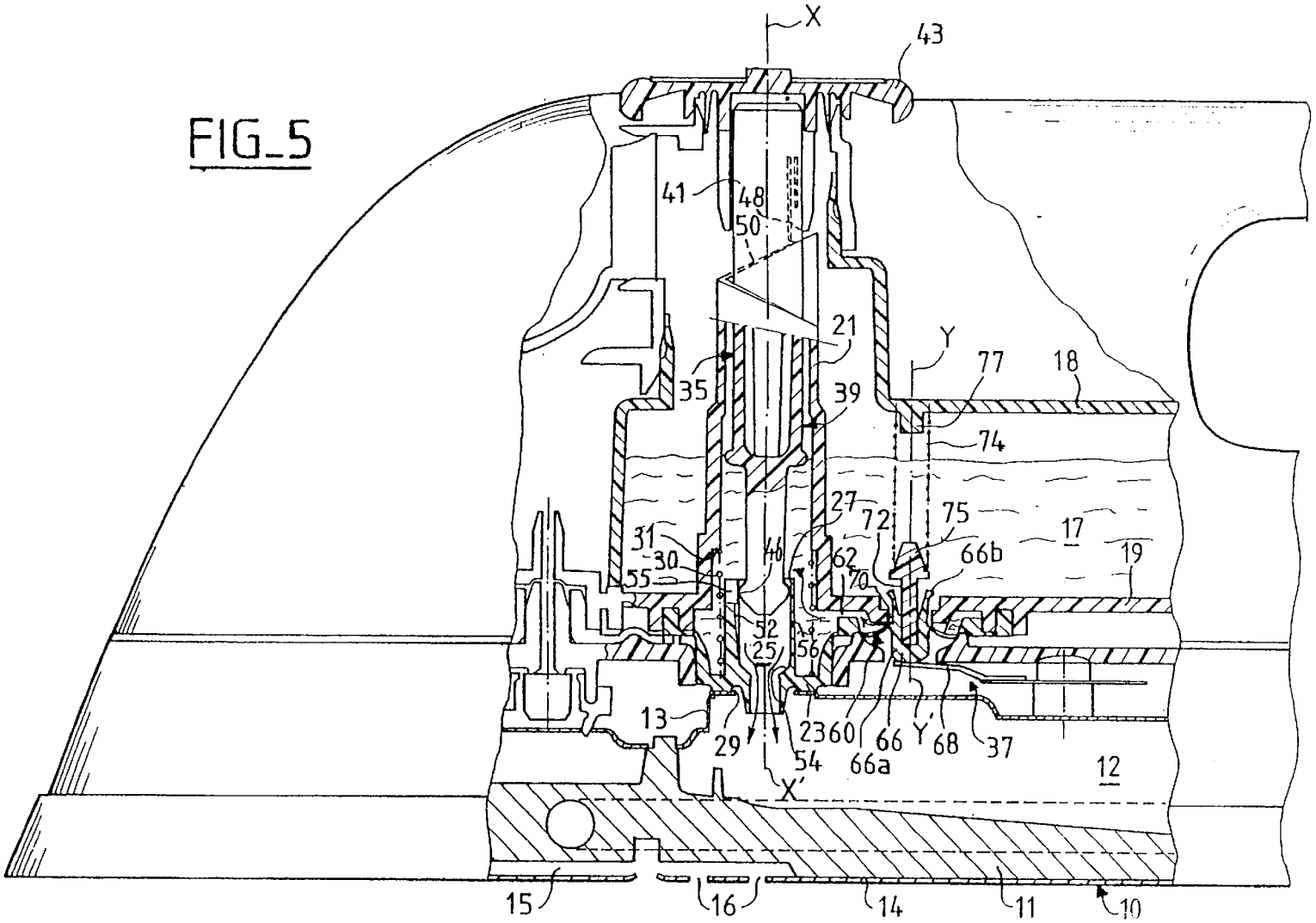

In this example, and as is seen clearly in FIG. 2, the passage 25 of the outlet 23 comprises at least one vertical slot 55, of which only one is shown in FIG. 2, which is provided over a portion of the height h of the outlet comprised between the upper end 52*b* of the groove 52 and the upper edge 27 of the passage 25, such that the throttle 39, because of its helicoidal movement upwardly along a predetermined path, comes to occupy a self-cleaning position (FIG. 5) in which the bulge 46 of the throttle 39 uncovers the slot 55 by being partially in bearing relation against the internal surface of the vertical wall 56 of the passage 25, so as to form a passage permitting an abundant flow of water into the vaporization chamber 12 so as completely to purge the iron at the end of pressing (see FIG. 5).

Preferably, the annular bulge 46 of the throttle 39 has an external diameter which is slightly greater than the internal diameter of the passage 25 of the outlet 23 of a flexible plastic material, such that during helicoidal movement of the throttle 39 in the passage 25, the bulge 46 of the throttle induces an elastic deformation by torsion, visible at 58 in FIG. 2, of the wall of the passage 25 by describing a helicoidal wave accompanying the movement of the throttle 39; the bulge 46 of the throttle 39 thus serves as a scraper permitting loosening scale that may deposit on the internal surface of the passage 25 of the outlet 23, between the narrowed portion 54 and the upper outlet of the passage 25.

In the embodiment shown in FIGS. 1 and 3 to 5, the anti-drip device 37 comprises a resilient membrane 60 shaped as a tulip which, preferably, is molded of a single piece with the outlet 23 of flexible plastic material for a substantial saving in production, and which is maintained in place below the wall of the bottom 19 of the reservoir 17. This membrane 60 communicates with the chimney 21 of the reservoir 17 through a water flow channel 62 delimited by a portion common to the membrane 60 and to the outlet 23 and by the external surface of the bottom wall 19 of the reservoir 17.

In this example, the resilient membrane 60 is constituted by a cup 64 (FIG. 1) whose central region is formed by a vertical cylindrical sleeve forming a flap valve 66, with an axis YY' parallel to the axis XX' of the throttle 39, whose lower end 66*a* is applied against a bi-metallic element 68 fixed on the vaporization chamber 12, and whose upper end

66*b* coacts with an opening 70 provided in the wall of the bottom 19 of the reservoir 17.

The sleeve 66 is axially movable between a rest position in which the bi-metallic element 68 is not activated and in which the upper end 66*b* of the sleeve 66 completely closes the opening 70, thereby preventing any passage of water from the reservoir 17 to the vaporization chamber 12 and thus corresponding to the dry position of the throttle 39 (see FIG. 1), and an active position in which the bi-metallic element 68 is activated and in which, under the action of this bi-metallic element 68, the upper end 66*b* of the sleeve 66 uncovers the opening 70, thereby permitting the passage of water from the reservoir 17 to the vaporization chamber 12 via the channel 62 and the passage 25 of the outlet 23, with a water flow rate adjusted according to the steam position (FIGS. 3 and 4) or to the self-cleaning (FIG. 5) of the throttle 39. The sleeve 66 in active position is urged toward its rest position by the resilience of the membrane 60.

So as to render freer the opening and above all the closure of the opening 70 of the water reservoir 17, the anti-drip device 37 also comprises a cylindrical vertical ferrule 72, coaxial with axis YY', and surrounded in its lower portion in the sleeve 66, as well as a spiral return spring 74, also coaxial with YY', and interposed between the upper portion in the form of a head 75 of the ferrule 72 and a projection 77 formed on the internal surface of the upper wall 18 of the reservoir 17. This spring 74 essentially promotes the closure of the opening 70 of the water reservoir 17 by the upper end 66*b* of the sleeve 66 when the latter is resiliently urged from its active position toward its rest position.

If the selected manner of pressing is dry pressing, the temperature of the sole plate 10 does not reach a value sufficient to activate the bi-metallic element 68, so that the sleeve 66 remains in its rest position in which the opening 70 of the reservoir 17 is closed by the upper end of the sleeve 66, thereby preventing the flow of water from the reservoir (FIG. 1). To iron dry, the user turns the button 43 so as to move the throttle 39 helicoidally downwardly, by the action of the cam 48 on the ramp 50, to bring it to its dry position, as shown in FIG. 1, in which the annular bulge 46 of the throttle 39 comes to rest on the narrowed portion forming a seat 54 of the passage 25 of the outlet 23, thereby completely closing the passage 25 of the outlet.

To use the iron in its steaming position, for example with a minimum water flow rate, the user turns the button 43 so as helicoidally to move the throttle 39, again by action of the cam 48 on the ramp 50, during the course of which displacement the annular bulge 46 of the throttle 39, by resilient deformation of the wall of the passage 25, loosens the scale which may have deposited on the internal surface of the passage 25, to bring the throttle 39 to its steaming position, as shown in FIG. 3, in which the annular bulge 46 of the throttle 39 bridges in a pointwise manner the lower end 52*a* of the groove 52. When the temperature of the sole plate 10 reaches a sufficient value, the bi-metallic element 68 is actuated and acts on the sleeve 66, which moves axially upwardly, against the force of the return spring 74, to occupy its active position in which it uncovers the opening 70 of the reservoir 17. The water leaving the reservoir 17 arrives in the chimney 21, at the same level as in the reservoir, after passage through the channel 62, then traverses pointwise the groove 52 at the level of its lower end 52*a* and, as a result, flows very regularly drop by drop into the vaporization chamber 12 (see FIG. 3). This injection gives rise to the emission of the desired steam, through holes 16 in the pressing plate 14.

Figure 4:
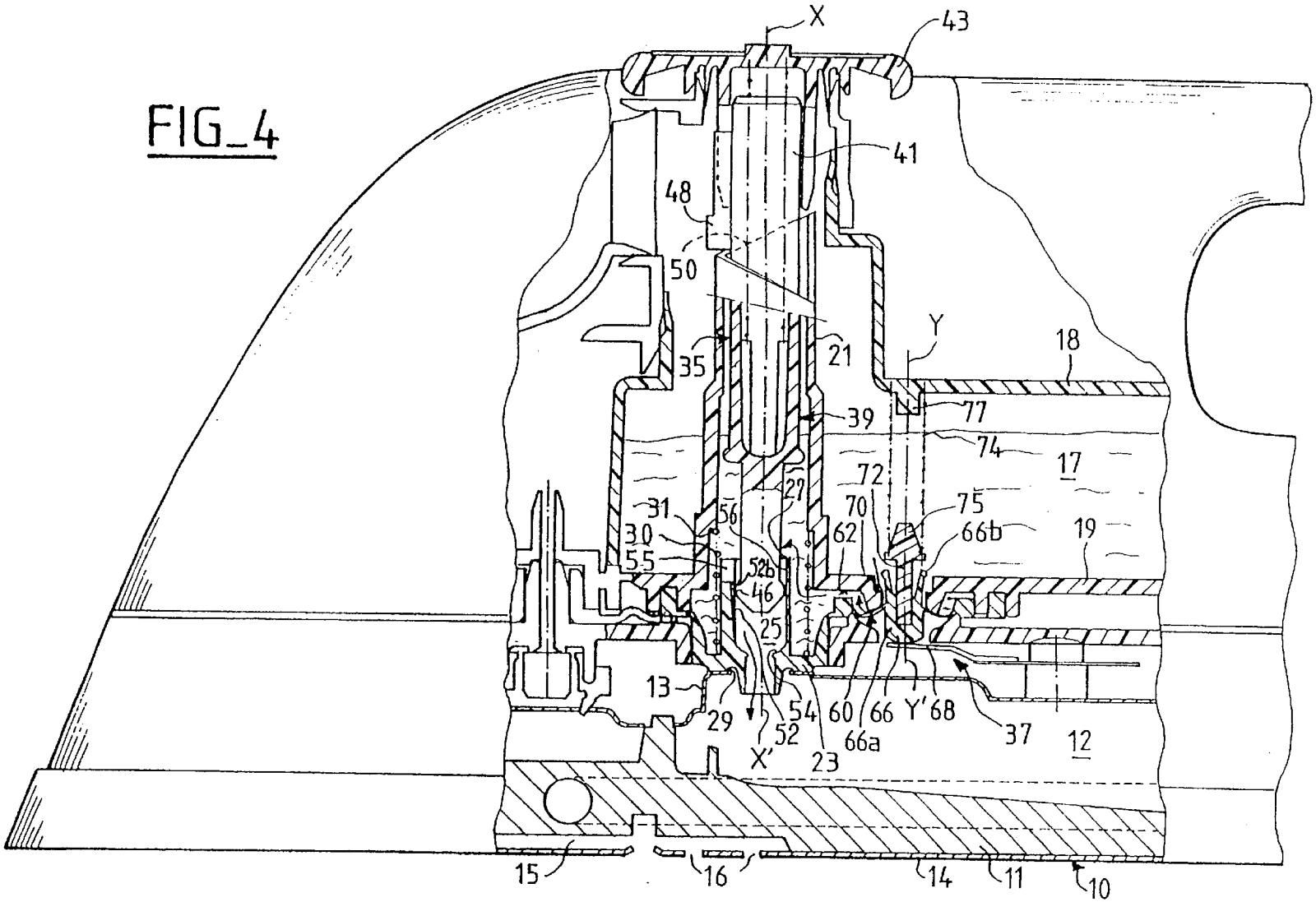

When the user now desires to press with a maximum steam flow rate for the purpose of heating the cloth or marking the crease in thick cloth, for example creases in shirts, he again turns the button 43 so as helicoidally to move the throttle 39, again by the action of the cam 48 on the ramp 50 and with scraping of the scale by the annular bulge 46 of the throttle, to bring the throttle 39 into its steaming position, as shown in FIG. 4, in which the annular bulge 46 of the throttle bridges pointwise the upper ends 52*b* of the groove 52. The opening 70 of the reservoir 17 being still uncovered, the water then passes pointwise through the groove 52 at the level of its upper end 52*b* and accordingly flows very regularly and in a swift stream into the vaporization chamber 12 (see FIG. 4). This injection gives rise to the abundant emission of the desired steam, through the holes 16 in the pressing plate 14.

At the end of pressing, when the user desires to purge the iron, he again turns the button 43 so as helicoidally to move the throttle 39, again by the action of the cam 48 on the ramp 50 and with scraping of the scale by the annular bulge 46 of the throttle, to bring the throttle 39 into its self-cleaning position, as shown in FIG. 5, in which the bulge 46 of the throttle completely uncovers the vertical slot 55 of the passage 25 whilst being partially in bearing relationship against the internal surface of the vertical wall 56 of the passage. The opening 70 of the reservoir being still uncovered, the water thus flows rapidly into the passage 25 through the slot 55 and, as a result, gushes abundantly into the vaporization chamber 12 (see FIG. 5). This gushing gives rise to a very abundant emission of steam, through the holes 16 of the pressing plate 14, thereby completely purging the reservoir 17 whilst eliminating formed scale.

When the user unplugs the iron after having purged it, namely when the throttle is in the steaming position (FIGS. 3 and 4), the sole plate 10 cools sufficiently after a certain time, that the bi-metallic element 68 returns to its initial position (see FIG. 1); the sleeve 66 is then returned to its rest position, both because of the resilience of the membrane 16 and under the action of the return spring 74, and thus closes with its upper end 66*b* the opening 70 of the reservoir 17, as shown in FIG. 1.

What is claimed is:

1. Steam iron comprising a water reservoir (17) communicating with a vaporization chamber (12) through an outlet (23) having a vertical communication passage (25), and a device (35) for adjusting the water admission flow rate into the vaporization chamber comprising a vertical throttle (39) whose lower end (44) has a bulge (46) and whose upper end (41) is secured to a manual control button (43), said throttle (39) being movable with an axial translation movement within the passage (25) of the outlet (23), under the action of the manual control button (43), between a so-called dry position in which the throttle (39) completely closes the passage (25), and at least one so-called steaming position in which the water can pass through the passage (25), characterized in that the bulge (46) of the throttle (39) is mounted gripped in the passage (25) of the outlet (23) and pointwise bridges a vertical groove (52) which is provided over a portion of the height of the passage (25) and which thus delimits with the bulge (46) of the throttle (39) a cross-section for passage of the water when the throttle (39) is in its steaming position.

2. Steam iron according to claim 1, characterized in that the passage (25) of the outlet (23) comprises a lower portion which is closed by the bulge (46) of the throttle (39) when this latter is in a dry position, whilst the vertical groove (52) extends above the lower portion of the passage (25) and has a continuously variable cross-section increasing toward the upper edge (27) of the passage (25), the throttle (39) thus passing from its dry position to its steaming position with an axial upward translatory movement.

3. Steam iron according to claim 2, characterized in that the lower portion of the passage (25) of the outlet (23) has a narrowed region (54) forming a seat for reception of the bulge (46) of the throttle (39) when this latter is in its dry position.

4. Steam iron according to claim 2, characterized in that the passage (25) of the outlet (23) is provided with at least one vertical slot (55) extending over a height (h) comprised between the upper end of the groove (52) and the upper edge (27) of the passage (25), such that the throttle (39), following an axial movement upwardly along a predetermined path, comes to occupy a so-called self-cleaning position in which the bulge (46) of the throttle (39) uncovers the slot (55) by being partially in bearing relation against the internal surface of the vertical wall (56) of the passage (25) so as to form a passage permitting abundant flow of water.

5. Steam according to any one of the preceding claims, characterized in that on the bottom wall (19) of the reservoir (17) is provided a vertical chimney (21) through which extends the vertical throttle (39) and which rises to a height greater than the maximum water level in the reservoir (17).

6. Steam iron according to any one of the preceding claims, in which the outlet (23) is of a flexible plastic material, and the passage (25) of the outlet (23) has a cylindrical shape, whilst the bulge (46) of the throttle (39) has an annular shape whose external diameter is slightly greater than the internal diameter of the passage (25), characterized in that the movable throttle (39) is subject to means (48, 50) permitting imposing on it a helicoidal movement resulting from a rotative movement accompanied by its axial translatory movement, the bulge (46) of the throttle (39) causing a resilient deformation of the passage (25) of the outlet (23) by describing a helicoidal wave accompanying the movement of the throttle (39) in the passage (25).

7. Steam iron according to claims 5 and 6, in which the manual control button (43) is rotatably mounted in the upper portion of the iron, characterized in that the means (48, 50) to impose a helicoidal movement on the throttle (39) comprise a cam (48) formed at the upper end (41) of the throttle (39) and adapted to move, by rotation of the button (43), over a ramp (50) formed at the upper end of the vertical chimney (21).

8. Steam iron according to any one of the preceding claims, comprising moreover an anti-drip device (37), characterized in that the anti-drip device (37) comprises a resilient membrane (60) shaped as a tulip arranged laterally of the outlet (23) and connected to this latter by a water flow channel (62), this membrane (60) comprising a cup (64) integrally traversed in its central region by a vertical cylindrical sleeve forming a flap valve (66) whose lower end **(66*a*) is supplied against a bimetallic element (68) fixed on the vaporization chamber (12), and whose upper end (66*b*) coacts with an opening (70) provided in the bottom wall (19) of the water reservoir (17) , said sleeve (66) being axially upwardly movable between a rest position in which the bimetallic element (68) is not activated and in which the upper end (66*b*) of the sleeve (66) completely closes said opening (70), preventing any passage of water from the reservoir (17) toward the vaporization chamber (12) and thus corresponding to a dry position of the throttle (39), and an active position in which the bi-metallic element (68) is activated and in which, under the action of the bi-metallic element, the upper end (66*b*) of the sleeve (66) uncovers the opening (70) so as to permit the passage of water from the reservoir (17) to the vaporization chamber (12) via the channel (62) and the passage (25) of the outlet (23) in which the throttle (39) is in its steaming position or in its self-cleaning position, said sleeve (66) returning to its rest position by the resilience of the membrane (60)**.

9. Steam iron according to claim 8, characterized in that the anti-drip device (37) also comprises a vertical cylindrical ferrule (72) whose lower portion is coaxially ensleeved in the sleeve (66) of the membrane (60), and a spiral return spring (74) for the sleeve (66) which is interposed in a manner coaxial to the sleeve between the upper portion in the form of a head (75) of the ferrule (72) and a projection (77) formed on the internal surface of the upper wall (18) of the water reservoir (17), the spring (74) promoting the closing of the opening (70) of the reservoir (17) by the upper end **(66*b*) of the sleeve (66)** when this latter is returned to its rest position.

10. Steam iron according to claim 8, characterized in that the outlet (23) and the membrane (60) are molded of a single piece from flexible plastic material.

11. Steam iron according to claim 10, wherein said plastic material is a silicone.

* * * * *